United States Patent [19]

Mulesa

[11] Patent Number: 4,724,895

[45] Date of Patent: Feb. 16, 1988

[54] FUME CONTROL IN STRAND CASTING OF FREE MACHINING STEEL

[75] Inventor: John L. Mulesa, Munster, Ind.

[73] Assignee: Inland Steel Company, Chicago, Ill.

[21] Appl. No.: 863,052

[22] Filed: May 14, 1986

[51] Int. Cl.[4] ..... B22D 11/10; B22D 11/126

[52] U.S. Cl. ..... 164/460; 164/253; 164/263; 164/473; 164/474; 266/157

[58] Field of Search ..... 164/460, 473, 474, 477, 164/459, 263, 417, 418, 253; 266/44, 144, 157, 50

[56] References Cited

U.S. PATENT DOCUMENTS

| | | | |
|---|---|---|---|
| 3,459,537 | 8/1969 | Hornak | 164/474 X |
| 3,539,168 | 11/1970 | Pfeuffer | 164/263 X |
| 4,524,819 | 6/1985 | Yoshimura | 164/473 X |
| 4,527,609 | 7/1985 | Nugent | 164/253 |
| 4,568,065 | 2/1986 | Talonen | 266/157 |

FOREIGN PATENT DOCUMENTS

| | | | |
|---|---|---|---|
| 3103402 | 8/1982 | Fed. Rep. of Germany | 164/263 |
| 2462218 | 3/1981 | France | 164/263 |

*Primary Examiner*—Nicholas P. Godici
*Assistant Examiner*—J. Reed Batten, Jr.
*Attorney, Agent, or Firm*—Marshall, O'Toole, Gerstein, Murray & Bicknell

[57] ABSTRACT

Lead or bismuth fumes emitted from steel during a strand casting operation are confined, collected and removed.

38 Claims, 5 Drawing Figures

FUME CONTROL IN STRAND CASTING OF FREE MACHINING STEEL

BACKGROUND OF THE INVENTION

The present invention relates generally to fume control in steel making operations and more particularly to fume control in the strand casting of steel to which fume-emitting ingredients are added.

Examples of fume-emitting alloying ingredients are lead and bismuth which are added to molten steel to improve the machinability properties of the solidified steel product.

In the strand casting of steel, molten steel is introduced from a ladle into a tundish from where the molten steel is directed into a casting mold where at least an outer shell of solidified steel is formed.

The fume-emitting ingredients may be added to the molten steel in the ladle, or they may be added to the stream of molten steel flowing from the ladle to the tundish. Aside from the ladle, fumes may be emitted from the molten stream between the ladle and the tundish and from th molten steel in the tundish.

In the strand casting process, the partially solidified steel moves downstream from the casting mold into a spray chamber in which the steel is sprayed with water to cool the steel and further solidify it. The solidified steel then moves into a run-out chamber located at the downstream end of the spray chamber. Relatively clean gases, devoid of fumes from the fume-emitting gases, are generated in the spray chamber and in the run-out chamber.

After the run-out chamber, the solidified steel strand moves to a torch-cutting station located immediately downstream of the run-out chamber where the strand is cut into pieces. Torch-cutting of the strand generates fumes from the fume-emitting ingredients in the solidified steel strand. These fumes must be prevented from escaping into the work place environment surrounding the strand casting equipment because the fumes can pose a health hazard. In the case of lead, the law restricts the quantity of lead bearing material which may be present in the work place environment as dust or fumes to no more than 50 micrograms per cubic meter.

The fumes emitted from the molten steel, or from the strand during the torch-cutting step, are at least initially in the form of lead or bismuth vapors which may then react with the atmosphere to form oxides of lead or bismuth. In accordance with the present invention, it matters not whether the fumes from the fume-emitting ingredients are in the form of metallic vapors or the oxides thereof. Both forms are equally undesirable.

Gases carrying fumes collected from steel making operations are normally passed through a bag house which removes the fumes from the carrying gases which are then exhausted to the atmosphere minus the fumes.

At the torch-cutting station, water sprays are used to wash scale and dross resulting from the torch-cutting step into a flume located beneath the steel strands at the torch-cutting station. Fumes generated during the torch-cutting step are removed from the torch-cutting locale by exhaust ducts. Because of the water sprays employed at the torch-cutting station, the gases exhausted from this location are wet and cool. It is undesirable to process wet, cool gases through a bag house because the moisture in such gases can precipitate in the bag house and interfere with the ability of the bag house to perform its fume-removing function.

SUMMARY OF THE INVENTION

The present invention provides a method and apparatus for severely restricting the amount of toxic fume which can escape from the strand casting operation into the surrounding work place environment.

The stream of molten steel is enclosed in a shroud as it passes between the ladle and the tundish. The tundish is covered and has an opening through which the molten steel may enter the tundish. A movable exhaust hood is positioned between the ladle and the tundish with an exhaust inlet located immediately adjacent the opening in the tundish. Baffles are provided to confine any fumes emitted through the opening in the tundish to the vicinity of the exhaust inlet.

After the tundish has been emptied of essentially all the steel that can be drained therefrom, it continues to emit some toxic fumes as it cools because of a residue of molten steel remaining in the tundish or sticking to the walls thereof. In accordance with the present invention, the tundish is moved from a casting to a non-casting position, together with its associated exhaust hood, and the fumes which continue to be emitted from the tundish while the latter is in its non-casting position, are collected through its associated exhaust hood.

The exhaust gases collected from the tundish while it is in its casting position, during the casting operation, before the tundish is emptied, are relatively hot and dry compared to the gases collected at the torch-cutting station. In accordance with the present invention, the hot, dry gase from the tundish are mixed with the cool, wet gases from the torch-cutting station, at a location upstream of the bag house, to raise the temperature of the gases collected at the torch-cutting location to a temperature above the dew point thereof to prevent precipitation within the bag house of moisture from the gases.

There is a substantial delay between the time the molten steel from the ladle first enters the tundish and the time the strand is first subjected to the torch-cutting operation. This delay period can be one hour, for example. The hot, dry gases generated at the tundish during this delay period are circulated through the bag house to preheat the bag house prior to the introduction therein of exhaust gases collected at the torch-cutting station. Preheating the bag house assists in preventing the precipitation therein of moisture in the gases collected at the torch-cutting station.

After the tundish has been essentially emptied, the temperature of the exhaust gases collected therefrom is substantially lower than the temperature of the exhaust gases collected from the tundish while it contained substantial amounts of molten steel. As a result, the gases collected from the tundish at this stage may not be hot enough to prevent precipitation in the bag house of moisture from gases collected at the torch-cutting station, when the latter are mixed with the gases from the tundish.

The present invention compensates for this heat deficiency by utilizing the clean gases generated at the run-out chamber located immediately upstream of the torch-cutting station. These gases, consisting essentially of hot air, are relatively hot and dry compared to the gases generated at the torch-cutting station. By mixing the hot, dry gases from the run-out chamber with the cool, wet gases from the torch-cutting station, precipitation of moisture in the bag house is prevented. The location of the run-out chamber, where the relatively hot, dry gases are generated, is sufficiently close to the torch-cutting station so that the hot, dry gases retain sufficient heat at the time they are mixed with the gases from the torch-cutting station to maintain the temperature of the mixed gases above the dew point thereof when the mixed gases enter the bag house. Moreover, because the gases from the run-out chamber are relatively dry, the percentage of water in the mixed gases is substantially less than the percentage of water in the gases from the torch-cutting station.

Large droplets of moisture, initially carried by the cool, wet gases collected from the torch-cutting station, are removed by passing these gases through a cyclone separator located upstream of the location where the gases from the torch-cutting station are mixed with gases from other locations in the strand casting operation. The fumes which are controlled in accordance with the present invention may be either metallic vapors or oxides of the fume-emitting ingredients, or both.

Othe features and advantages are inherent in the method and apparatus claimed and disclosed or will become apparent to those skilled in the art from the following detailed description in conjunction with the accompanying diagrammatic drawings.

DETAILED DESCRIPTION

Figure 1:
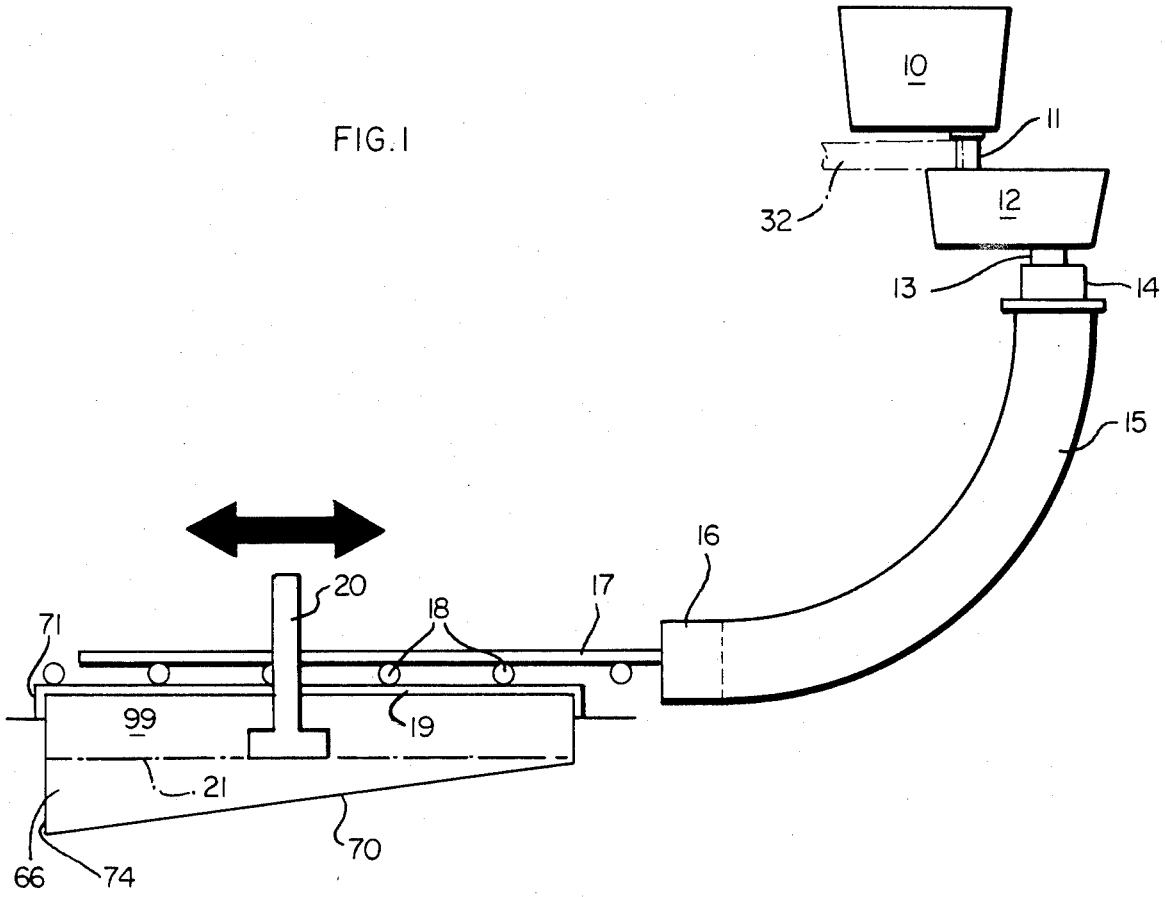
FIG. 1 is a schematic flow diagram of a strand casting operation.

FIG. 1 illustrates a strand casting operation wherein molten steel from a ladle 10 is introduced through a shroud 11 into a tundish 12 from which the molten steel passes through tundish nozzles 13 into a casting mold 14 wherein the steel is at least partially solidified. The steel then moves along an arcuate path through a spray chamber 15 of conventional construction employing conventional water spray nozzles to cool the steel as it moves along the arcuate path. Located at the downstream end of spray chamber 15, and separate and discrete therefrom, is a run-out chamber 16 from which emerges a solid steel strand 17 which passes over rollers 18 to a torch-cutting station comprising a cutting table 19 having an open top and associated with a torch-cutting device 20 of conventional construction which moves back and forth along a path at 21 to cut strand 17 into a multiplicity of pieces, e.g. steel billets. Conventional water sprays (not shown), normally associated with such a torch-cutting device, are employed at the torch-cutting station.

Figure 3:
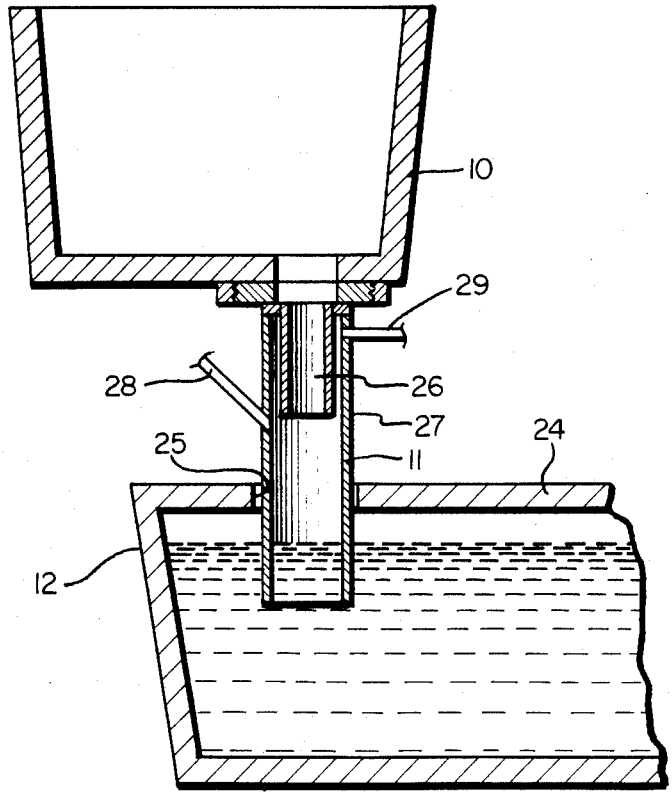
FIG. 3 is a fragmentary, vertical sectional view illustrating a portion of the strand casting equipment illustrated schematically in FIG. 1.

FIG. 3 shows tundish 12 located in a casting position directly below ladle 10. Tundish 12 comprises a top cover 24 having an opening 25. Extending from the bottom of ladle 10 toward tundish opening 25 is a conduit 26 for directing molten steel from ladle 10 through tundish opening 25. Enclosing conduit 26 is a tubular, outer shroud 27 extending from the bottom of ladle 10 through opening 25 in the top 24 of tundish 12. Shroud 27 encloses both conduit 26 and the stream of molten steel directed by the latter into tundish 12 and helps protect the stream of molten steel from the atmosphere outside the stream of molten steel.

Fume-emitting ingredients, such as lead or bismuth, are introduced into the stream of molten steel through a tube 28 extending at a downward angle through the wall of tubular shroud 27. Another tube 29 communicates with the interior of shroud 27 for introducing a pressure-regulating gas into the interior of shroud 27. The apparatus illustrated in FIG. 3 is described in greater detail in U.S. application Ser. No. 731,077 filed May 6, 1985, now U.S. Pat. No. 4,602,949 and the disclosure thereof is incorporated herein by reference.

Figures 2, 4, 5:
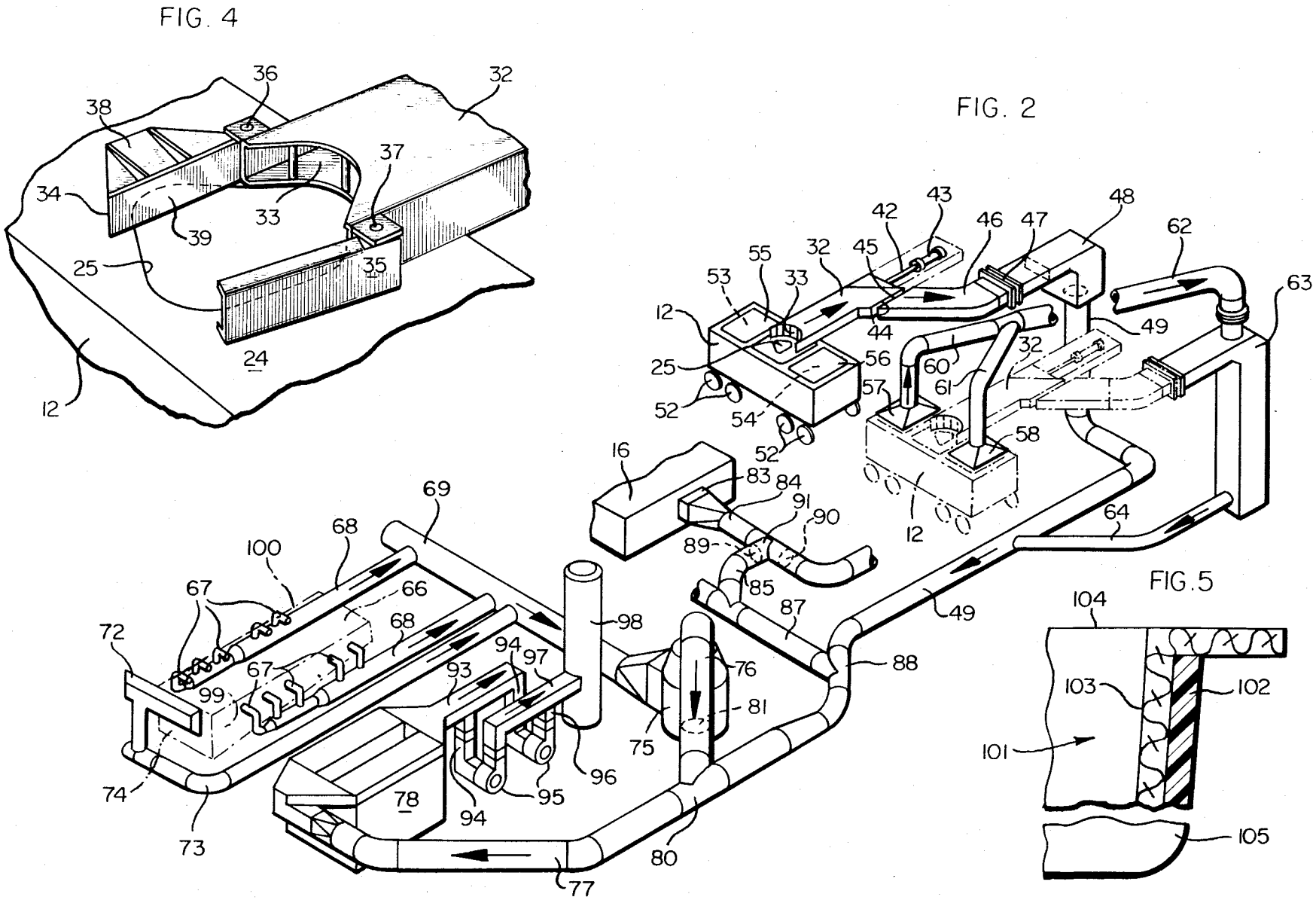
FIG. 2 is a perspective of an embodiment of apparatus in accordance with the present invention.
FIG. 4 is a fragmentary perspective of a portion of one embodiment of apparatus in accordance with the present invention.
FIG. 5 is a fragmentary, vertical sectional view of a bag house bag in accordance with an embodiment of the present invention.

The introduction of fume-emitting ingredients into the molten steel entering tundish 24 generates fumes at tundish 24 and in shroud 27. These fumes can escape through that part of tundish opening 25 not occupied by the cross section of shroud 27. These fumes are prevented from polluting the work place environment by apparatus illustrated in FIGS. 1, 2 and 4. To collect the fumes generated in the tundish and the shroud, an exhaust hood 32 is located between ladle 10 and tundish 12 (FIG. 1). Exhaust hood 32 has an inlet 33 which is located adjacent top opening 25 of tundish cover 24 (FIG. 4). Exhaust inlet 33 has an arcuate shape conforming to the shape of that part of tundish top opening 25 where exhaust inlet 33 is located. As shown in FIG. 4, tundish top opening 25 has an irregular shape to accommodate tilting of shroud 11 to facilitate the positioning of the shroud in opening 25.

Extending from exhaust conduit 32, on opposite sides of inlet 33, are a pair of baffles 34, 35 which are normally located adjacent tundish opening 25 when exhaust inlet 33 is similarly located. Baffles 34, 35 extend between the bottom of ladle 10 and tundish top cover 24. Baffles 34, 35 perform the function of substantially confining toxic fumes from tundish 12 and shroud 11 to the vicinity of exhaust inlet 33.

Baffles 34, 35 are mounted on hood 32, at 36 and 37 respectively (FIG. 4), for pivotal movement of the baffles, relative to hood 32, toward and away from each other. This facilitates positioning of the baffles to perform their intended function. As shown in FIG. 4, baffle 34 comprises a bottom portion 38 for covering at least part of top opening 25 on tundish 12. Extending upwardly from bottom portion 38 is a wall portion 39.

Referring to FIG. 2, exhaust conduit 32 is connected to one end of a piston rod 42 reciprocable within an air actuated cylinder 43 for moving exhaust conduit 32 relative to tundish opening 25, back and forth along a horizontal path, between an extended, operative position adjacent opening 25 and a retracted, displaced position relatively remote from opening 25.

Exhaust hood 32 has an outlet end 44 communicating with the inlet end 45 of a coupling 46 when exhaust hood 32 is in its operative position. Coupling 46 has an outlet end 47 for communicating with another coupling 48 in turn communicating with a conduit 49.

Tundish 12 is part of an assembly also comprising exhaust hood 32, piston rod 42 and cylinder 43, and coupling 45, as well as supporting framework (not shown). This assembly is mounted on a car having wheels 52, 52 for moving the assembly from a casting position (solid lines in FIG. 2) to a non-casting position (dash-dot lines in FIG. 2).

For a time after it has been drained of all the molten steel which can be withdrawn therefrom, the tundish continues to emit toxic fumes. At this stage, the tundish must be moved from the casting position, where fume collection is available, to the non-casting position so that other parts of the strand casting equipment can be readied for the next cast.

The tundish is often preheated at the non-casting position, before the start of the strand casting operation. When a tundish has been previously used for the strand casting of molten steel containing fume-emitting ingredients, there is a residue in the refractory lining of the tundish which, during preheating, will vaporize and emit fumes.

The present invention provides for the capture of toxic fumes emitted from the tundish when the latter is in the non-casting position. Referring to FIG. 2, exhaust hood 32 is normally retracted to its displaced position (dash-dot lines above cylinder 43) when the tundish and associated equipment are moved from the casting to the non-casting position. Hood 32 is moved back to its operative position, wherein inlet 33 is adjacent opening 25 in tundish 12, when the assembly is at the non-casting position so as to capture fumes escaping through opening 25. Located in tundish top 24, on opposite sides of opening 25, and spaced from opening 25, are a pair of exhaust vents 53, 54 each covered by a respective plate 55, 56 when the tundish is in its casting position (solid lines in FIG. 2). However, when the tundish is in its non-casting position (dash-dot lines in FIG. 2), the cover plates, 55, 56 are removed from over exhaust vents 53, 54, and fumes escaping through these vent openings are exhausted through additional hoods 57, 58 located at the non-casting position.

Exhaust hoods 32, 57 and 58 are all employed to exhaust fumes from tundish 12 when the latter is in its non-casting position, either during a preheating operation or after a casting operation while the tundish continues to emit toxic fumes.

Exhaust hoods 57, 58 each communicate with a respective branch conduit 60, 61 each communicating with a main conduit 62 communicating with a coupling 63 in turn communicating with a connecting conduit 64 which communicates with conduit 49. Conduit 49 is employed to remove fumes generated at the tundish when the latter is in its casting position (solid lines in FIG. 2).

Exhaust hood 32 typically has a cross sectional area sufficient to provide a 7,000 ft./min. (2134 m/min.) capture velocity in the vicinity of tundish opening 25 when the tundish is in the casting position. This will maintain the toxic fumes in the work place environment surrounding tundish opening 25 below the required maximum of 50 micrograms per cubic meter. The rest of the exhaust system downstream of hood 32 also has a capacity sufficient to maintain these conditions.

Referring to FIGS. 1 and 2, located below the torch-cutting station at table 19 is a flume 66 for collecting the dross and scale which falls from slab 17 through the open top of table 19 during the torch-cutting step. Flume 66 also collects water which falls from above as a result of the water sprays (not shown) which accompany the torch-cutting step. Flume 66 has a pair of opposite sides 99,100 on each of which is located a plurality of exhaust outlets 67, 67 communicating with an exhaust manifold 68 communicating with a conduit 69. Fumes generated by the torch-cutting step are drawn into flume 66 and exhausted therefrom through exhaust outlets 67, 67.

Flume 66 has a bottom 70 which slopes downwardly in a downstream direction. This causes the water which drops into flume 66 to flow in the downstream direction, creating a downstream current, to wash downstream the scale and dross which falls into flume 66. The current in flume 66 also causes some of the fumes drawn into flume 66 to be carried towards the downstream end 74 of flume 66, and at least part of these fumes avoid removal through exhaust outlets 67, 67. To prevent these fumes from escaping into the work place environment surrounding downstream flume end 74, an exhaust hood 72 is provided immediately downstream of, and above, the downstream end 71 of table 19 (FIG. 2). Exhaust hood 72 communicates with a conduit 73 in turn communicating with conduit 69 which, as noted above, also connects to exhaust manifolds 68, 68. Exhaust hood 72 will also collect any fumes generated by a sample cut-off device (not shown) normally located adjacent downstream end 71 of table 19.

In summary, exhaust outlets 67, 67 collect gases at a location directly below the torch-cutting station, and exhaust hood 72 collects gases at the downstream end of the torch-cutting station, a location immediately downstream of the furthest downstream position to which torch-cutting device 20 moves as it performs the torch-cutting step. As shown in FIG. 2, exhaust hood 72 is located above exhaust outlets 67, 67.

Gases collected at exhaust hood 72 and exhaust outlets 67, 67 are conducted by conduit 69 to a cyclone separator 75 wherein large droplets of moisture are separated from the gases which then exit through the top of separator 75 into a conduit 76.

The gases entering conduit 69 contain moisture as a result of the water sprays employed at the torch-cutting station. Accordingly, the gases in conduit 69 are relatively cool and wet compared to the gases exhausted from the tundish into conduit 49. The gases exiting from cyclone separator 75 through conduit 76, although stripped of large droplets of water, are still relatively wet and cool. These gases are conveyed through a conduit 77 to a bag house 78 for removing from the gases the toxic ingredients therein, e.g. oxides of lead and bismuth.

It is undesirable that gases entering a bag house have a temperature below the dew point of the gases because this causes moisture in the gases to precipitate in the bag house thereby interfering with the ability of the bag house to perform its intended function. More particularly, in a bag house, dirty gases are drawn through the walls of vertically extending fabric bags, from the outside to the inside of the bags. As the gases pass through the fabric walls of the bags, they are cleaned of dust particles which accumulate on the outside of the bag walls. The cleaned gases entering the inside of the bags are conducted further downstream and eventually exhausted to the atmosphere. Periodically, when the dust accumulating on the outside of the bag walls gets too thick, the bags are shaken to dislodge the dust. This is necessary because an overly thick dust layer will impede the passage of gas through the bag. If the gases have a temperature below the dew point thereof, moisture in the gases will precipitate on the outside of the bag walls, causing the dust particles which accumulate there to cake, and this interferes with the dislodgement of the dust particles from the bag walls. On the other hand, if the temperature of the gases are above the dew point thereof, the moisture is in the form of a vapor and it will pass through the bag walls with the cleaned gases.

Raising the temperature of the cool, wet gases from the torch-cutting station to a temperature above the dew point thereof is accomplished by mixing these gases with the relatively hot, dry gases exhausted from the tundish. Mixing of the gases also produces an $H_2O$ percentage therein substantially less than the $H_2O$ percentage in the gases from the torch-cutting station just before mixing. The increase in gas temperature and the decrease in $H_2O$ percentage, compared to the corresponding conditions in the gases from the torch-cutting station, both contribute to reducing the likelihood of $H_2O$ precipitation in the bag house.

Mixing of the gases begins at a junction 80 where conduit 76, containing the relatively wet, cool gases from the torch-cutting station, joins conduit 49 containing the relatively hot, dry gases from the tundish. Conduits 76 and 49 join at junction 80 to form conduit 77. Junction 80, is upstream of bag house 78.

There is a substantial delay period between the beginning of the molten steel introducing step at tundish 12 and the beginning of the torch-cutting step at table 19. During this delay period, the hot, dry gases generated at tundish 12 are directed through conduits 49 and 77 into bag house 78 to preheat the bag house before any fumes from a torch-cutting step are directed into the bag house. This reduces the precipitation of moisture in the bag house when the gases from the torch-cutting station are eventually directed therethrough. More particularly, the gases used to preheat bag house 78 during the delay period are hotter than the mixed gases which will enter the bag house after the delay period. Accordingly, at least at the beginning of the time when the mixed gases enter the bag house, the bag house is at a substantially greater temperature than the entering gases. Eventually, of course, the temperature of the bag house will drop and approach that of the mixed gases entering the bag house, but the temperature of the bag house will not drop below the dew point of the entering mixed gases, which are maintained at a temperature above the dew point thereof.

During the delay period, a damper 81 in conduit 76 is closed to prevent cool gases from being drawn into conduit 77 at junction 80. During this period, no fumes are being generated at the torch-cutting station because that station is inoperative.

Just as the introduction of molten steel into the tundish proceeds for a substantial period before the beginning of the torch-cutting step, so also the torch-cutting step proceeds for a substantial period after the conclusion of the introduction of molten steel into the tundish. Thus there will continue to be a substantial generation of cold, wet fumes at the torch-cutting station during a time when there is a substantial diminution, if not a total cessation, in the generation at the tundish of hot, dry gases which can be mixed with the cool, wet gases at junction 80. To prevent the gases entering bag house 78 from dropping below the dew point thereof, the wet, cool gases entering conduit 77 from conduit 76 are mixed with hot, dry gases from another source.

More particularly, as slab 17 passes through run-out chamber 16, the slab is still relatively hot. The slab is not subjected to spray cooling in run-out chamber 16, so that the air within run-out chamber 16 is heated by slab 17, and that air is neither cooled nor moistened by water sprays. Thus, the gases within run-out chamber 16 are relatively hot and dry compared to the gases exhausted from the torch-cutting station.

The hot, dry gases in run-out chamber 16 are withdrawn through an exhaust outlet at 83 communicating with a conduit 84 in turn communicating with a connecting conduit 85 communicating with another conduit 87 which joins conduit 49 at a junction 88.

As previously noted, run-out chamber 16 is located at the downstream end of spray chamber 15 and is immediately upstream of the torch-cutting station. Run-out chamber 16 is sufficiently close to the torch-cutting station so that the hot, dry gases withdrawn from run-out chamber 16 retain sufficient heat at the time they reach junction 80, where they are mixed with the cold, wet gases from the torch-cutting station, to maintain the temperature of the mixed gases above the dew point thereof when the mixed gases enter bag house 78.

Connecting conduit 85 contains a damper 89, and conduit 84 contains a damper 90 located downstream of the junction 91 between conduit 84 and connecting conduit 85. Damper 89 is opened and damper 90 is closed when the hot, dry gases from run out chamber 16 are to be mixed with the cool, wet gases from the torch-cutting station. Damper 89 is closed and damper 90 is opened when the gases from run-off chamber 16 are not to be mixed with the gases from the torch-cutting station. In that instance, the gases flowing through conduit 84 bypass bag house 78.

Clean gases from bag house 78 flow into an exhaust conduit 93 which communicates with a pair of inlet conduits 94, 94 each leading into a respective blower 95, each having an outlet conduit 96, communicating with a conduit 97 in turn communicating with a stack 98.

Referring now to FIG. 5, bag house 78 contains a plurality of bag-type filters each comprising a fabric sock 101 having an open top 104 and a closed bottom 105, and into which the gas passes from the outside forming a film of dust on the sock which acts as a filtering medium. Bag house exhaust outlet 93 (FIG. 2) is in communication with the open top 104 on each sock. Each sock 101 is supported at the top 104 in a conventional manner (not shown). When the film of dust becomes too thick, the exit end of the sock may be closed at 104 thereby shutting off the gas flow, and the sock may be shaken or vibrated to drop the excess dust into a collecting hopper at the bottom of the socks. Alternatively, the socks may be "pulsed" by directing an air blast down through the open top 104 of each sock, e.g. by reversing blowers 95, 95.

As noted above, if the temperature of the gas entering the bag house drops below its dew point, moisture will precipitate on the fabric wall of the sock, thereby forming a caked deposit of dust on the sock which would be extremely difficult if not impossible to dislodge. In a preferred embodiment of the present invention, illustrated in FIG. 5, this problem is avoided by lining the outside of each sock 101 with a layer or membrane 102 of polytetrafluoroethylene (e.g. Teflon). In effect, the sock has an inner layer 103 of fabric, and an outer layer or membrane 102. This has tw advantages. The membrane has pores which are so small that it does a much more efficient job than the fabric of excluding dust particles from passing into the interior of the sock. In addition, membrane 102 is much smoother than the fabric so that, even if moisture does precipitate and cause caking on the membrane, the caked material will not stick thereto but will slide off the membrane when the sock is pulsed.

Th foregoing detailed description has been given for clearness of understanding only, and no unnecessary limitations should be understood therefrom, as modification will be obvious to those skilled in the art.

I claim:

1. In the strand casting of steel wherein undesirable fumes are generated, a method for preventing said fumes from polluting the work-place environment, said method comprising the steps of:

introducing a stream of molten steel from a ladle into a tundish located in a casting position below the ladle;

providing said tundish with a cover having an opening;

directing said molten steel through a conduit extending from the bottom of the ladle toward said opening in the covered tundish;

enclosing said conduit within a tubular outer shroud extending from said ladle bottom through said opening in the covered tundish;

adding fume-emitting ingredients to said stream of molten steel in said outer shroud;

locating, between said ladle and said tundish, an exhaust hood having an inlet;

locating said inlet adjacent said top opening of the covered tundish;

collecting fumes generated in said tundish and said shroud at said exhaust hood through said inlet;

locating, adjacent said top opening, baffles extending between the bottom of the ladle and the top of the covered tundish;

and substantially confining said fumes to the vicinity of said exhaust inlet with said baffles.

2. A method as recited in claim 1 wherein said tundish continues to emit said fumes after the completion of the strand casting operation, said method comprising:

moving both the tundish and said exhaust hood from said casting position to a non-casting position;

and collecting fumes, emitted by said tundish at the non-casting position, with said exhaust hood.

3. A method as recited in claim 2 wherein said tundish has at least one exhaust vent in the tundish top at a location spaced from said top opening in the tundish, and said method comprises:

exhausting fumes from said tundish through an additional hood located over said exhaust vent.

4. A method as recited in claim 1 wherein said tundish is preheated before said strand casting operation and emits said fumes during the preheating due to a residue of fume-generating material remaining in the tundish from a previous strand casting operation, said method comprising:

conducting said preheating at a non-casting position displaced from said casting position;

moving said tundish between said casting and non-casting positions together with said exhaust hood;

and collecting fumes, emitted by said tundish during said preheating, with said exhaust hood.

5. A method as recited in claim 4 wherein said tundish has at least one exhaust vent in the tundish top at a location spaced from said top opening in the tundish, and said method comprises:

exhausting fumes from said tundish through an additional hood located over said exhaust vent.

6. In the strand casting of steel wherein undesirable fumes are generated, a method for preventing said fumes from polluting the work-place environment, said method comprising the steps of:

introducing a stream of molten steel from a ladle into a tundish located in a casting position below the ladle;

collecting fumes generated in said tundish, said fumes being relatively hot and dry;

casting said molten steel into a strand at a location below the tundish;

torch cutting said strand;

generating fumes at said torch cutting step which are relatively cool and wet compared to the hot, dry fumes generated at said tundish;

there being a substantial delay period between the beginning of said molten steel introducing step at the tundish and said torch cutting step;

collecting gases containing said fumes from the torch cutting step and directing said gases through a bag house to clean the gases;

and directing gases containing the hot, dry fumes generated at said tundish through said bag house during said delay period to preheat the bag house before the fumes from the torch cutting step are directed into the bag house, thereby to reduce the precipitation of moisture in the bag house when the fumes from the torch cutting step are directed therethrough.

7. A method as recited in claim 6 and comprising:

mixing said relatively hot, dry fumes from the tundish with said relatively cool, wet fumes from the torch cutting step, at a location upstream of said bag house, during the period when fumes are generated at both the tundish and the torch cutting location.

8. In the strand casting of steel wherein undesirable fumes are generated, a method for preventing said fumes from polluting the work-place environment, said method comprising the steps of:

introducing a stream of molten steel from a ladle into a tundish located in a casting position below the ladle;

casting said molten steel into a strand at a location below the tundish;

spray cooling said strand downstream of the tundish;

torch cutting the strand downstream of said spray cooling step;

generating fumes at said torch cutting step which are relatively wet and cool;

and collecting gases containing said fumes from the torch cutting step and directing said gases through a bag house to clean the gases;

said gases being collected at a first collecting location directly below the location where said torch cutting step is performed and at a second collecting location immediately downstream of the location where said torch cutting step is performed and above said first collecting location.

9. In the strand casting of steel wherein undesirable fumes are generated, a method for preventing said fumes from polluting the work-place environment, said method comprising the steps of:

introducing a stream of molten steel from a ladle into a tundish located in a casting position below the ladle;

casting said molten steel into a strand at a location below the tundish;

spray cooling said strand downstream of the tundish;

torch cutting the strand downstream of said spray cooling step;

generating fumes at said torch cutting step which are relatively wet and cool;

generating gases, immediately downstream of said spray-cooling step and upstream of said torch cutting step, which are relatively hot and dry;

collecting gases containing said fumes from the torch cutting step and directing said gases through a bag house to clean the gases;

collecting the relatively hot, dry gases generated immediately downstream of the spray cooling step;

and mixing said relatively hot, dry gases generated downstream of said spray cooling step with said relatively cool, wet fumes from the torch cutting step, at a location upstream of said bag house.

10. A method as recited in claim 9 and comprising:

subjecting said gases from said torch cutting step to a cyclone separating step, before said mixing step, to remove relatively large droplets of moisture from said gases.

11. A method as recited in claim 9 wherein:

the location where said relatively hot, dry gases are generated is sufficiently close to the location of said torch cutting step so that said hot, dry gases retain sufficient heat at the time of said mixing step to maintain the temperature of the mixed gases above the dew point thereof when the mixed gases enter the bag house.

12. In the strand casting of steel wherein undesirable fumes are generated, a method for preventing said fumes from polluting the work-place environment, said method comprising the steps of:

introducing a stream of molten steel from a ladle into a tundish located in a casting position below the ladle;

collecting fumes generated in said tundish, said fumes being relatively hot and dry;

casting said molten steel into a strand at a location below the tundish;

torch cutting said strand;

generating fumes during said torch cutting which are relatively cool and wet compared to the hot, dry fumes generated at said tundish;

collecting gases containing said fumes from the torch cutting step and directing said gases through a bag house to clean the gases;

and mixing said relatively hot, dry fumes from the tundish with said relatively cool, wet fumes from the torch cutting step at a location upstream of said bag house, during the period when fumes are generated at both the tundish and the torch cut-off location.

13. A method as recited in claim 12 and comprising:

providing said tundish with a cover having an opening;

directing said molten steel into said covered tundish through a conduit extending from the bottom of the ladle toward said opening in the covered tundish;

enclosing said conduit within a tubular outer shroud extending from said ladle bottom through said opening in the covered tundish;

adding fume-emitting ingredients to said stream of molten steel in said outer shroud;

locating, between said ladle and said tundish, an exhaust hood having an inlet;

locating said inlet adjacent said top opening of the covered tundish;

collecting fumes generated in said tundish and said shroud at said exhaust hood through said inlet;

locating, adjacent said top opening, baffles extending between the bottom of the ladle and the top of the covered tundish;

and substantially confining said fumes to the vicinity of said exhaust inlet with said baffles.

14. A method as recited in claim 12 and comprising:

spray cooling said strand downstream of the tundish and upstream of the torch cutting step;

generating gases, immediately downstream of said spray-cooling step and upstream of said torch cutting step, which are relatively hot and dry;

collecting the relatively hot, dry gases generated immediately downstream of the spray cooling step;

and mixing said relatively hot, dry gases generated downstream of said spray cooling step with said relatively cool, wet fumes from the torch cutting step, at a location upstream of said bag house.

15. A method as recited in claim 14 wherein:

there is a substantial delay period between the beginning of said molten steel introducing step at the tundish and said torch cutting step;

said method comprising directing gases containing the hot, dry fumes generated at said tundish through said bag house during said delay period to preheat the bag house before the fumes from the torch cutting step are directed into the bag house, thereby to reduce the precipitation of moisture in the bag house when the fumes from the torch cutting step are directed therethrough.

16. A method as recited in claim 14 and comprising:

subjecting said gases from said torch cutting step to a cyclone separating step, before any of said mixing steps, to remove relatively large droplets of moisture from said gases.

17. A method as recited in claim 14 wherein:

the location where said relatively hot, dry gases are generated is sufficiently close to the location of said torch cutting step so that said hot, dry gases retain sufficient heat at the time of said mixing step to maintain the temperature of the mixed gases above the dew point thereof when the mixed gases enter the bag house.

18. In the strand casting of steel wherein undesirable fumes are generated, a method for preventing said fumes from polluting the work-place environment, said method comprising the steps of:

introducing a stream of molten steel from a ladle into a tundish located in a casting position below the ladle;

casting said molten steel into a strand at a location below the tundish;

spray cooling said strand downstream of the tundish;

torch cutting the strand downstream of said spray cooling step;

generating fumes at said torch cutting step which are relatively wet and cool;

collecting gases containing said fumes from the torch cutting step and directing said gases through a bag house having bags to clean the gases;

accumulating dust from said gases on the outside of the bags in said bag house;

and preventing the moisture in said wet, cool fumes from interfering with the removal of accumulated dust from the outside of said bags, by providing the outside of said bags with a membrane composed of polytetrafluoroethylene.

19. In a metallurgical process which generates gases containing dust and moisture, a method for cleaning said gases, said method comprising the steps of:

directing said gases through a bag house having bags;

accumulating dust from said gases on the outside of the bags in said bag house;

and preventing the moisture in said gases from interfering with the removal of accumulated dust from the outside of said bags, by providing the outside of the bags with a membrane composed of polytetrafluoroethylene.

20. An apparatus for strand casting steel, wherein undesirable fumes are generated, and for preventing said fumes from polluting the work-place environment, said apparatus comprising:

a ladle for containing molten steel;

a covered tundish having a top opening and located in a casting position below the ladle;

a conduit extending from the bottom of the ladle toward said opening in the top of the covered tundish;

said conduit comprising means for directing a stream of molten steel from said ladle to said tundish;

a tubular outer shroud enclosing said conduit and extending from said ladle bottom through said opening in the covered tundish;

means for adding fume-emitting ingredients to said stream of molten steel in said outer shroud;

an exhaust hood located between said ladle and said tundish and having an exhaust inlet located adjacent said top opening of the covered tundish;

said exhaust hood comprising means for collecting fumes generated in said tundish and said shroud;

and baffles located adjacent said top opening and extending between the bottom of the ladle and the top of the covered tundish;

said baffles comprising means for substantially confining said fumes to the vicinity of said exhaust inlet.

21. An apparatus as recited in claim 20 and comprising:

means for moving said exhaust hood relative to said tundish opening, back and forth along a horizontal path, between an operative position adjacent said opening and a displaced position remote from said opening.

22. An apparatus as recited in claim 20 and comprising:

means for moving both the tundish and said exhaust hood from said casting position to a non-casting position;

said exhaust hood comprising means for collecting fumes emitted by said tundish at the non-casting position.

23. An apparatus as recited in claim 22 wherein:

said tundish has at least one exhaust vent in the tundish top at a location spaced from said top opening in the tundish;

said apparatus comprising an additional hood and means for locating said additional hood over said exhaust vent to exhaust fumes from said tundish through the additional hood.

24. An apparatus as recited in claim 22 and comprising:

means for moving said exhaust hood relative to said tundish opening, back and forth along a horizontal path, between an operative position adjacent said opening and a displaced position remote from said opening.

25. An apparatus as recited in claim 20 and comprising:

means mounting said baffles on said exhaust hood for pivotal movement of the baffles, relative to the exhaust hood, toward and away from each other.

26. An apparatus as recited in claim 25 wherein at least one of said baffles comprises:

a bottom portion for covering at least part of said top opening in the tundish;

and wall means extending upwardly from said bottom portion.

27. An apparatus for strand casting steel, wherein undesirable fumes are generated, and for preventing said fumes from polluting the work-place environment, said apparatus comprising:

a ladle;

a tundish comprising means for receiving a stream of molten steel from said ladle;

means for collecting fumes generated in said tundish;

means for casting said molten steel into a strand at a location below said tundish;

means located downstream of said casting means, for torch cutting said strand and for generating fumes which are relatively cool and wet compared to the fumes generated at said tundish;

means for providing a substantial delay period between the initial reception of said molten steel at the tundish and the time said strand first reaches said torch cutting means;

a bag house;

means for collecting gases containing said fumes generated at the torch cutting means and for directing said gases through said bag house to clean the gases;

and means for directing gases containing the fumes generated at said tundish through said bag house during said delay period to preheat the bag house before the fumes generated at said torch cutting means are directed into the bag house.

28. An apparatus as recited in claim 27 and comprising:

means for mixing said fumes from the tundish with said relatively cool, wet fumes from the torch cutting means, at a location upstream of said bag house.

29. An apparatus as recited in claim 28 and comprising:

a cover on said tundish;

an opening in said cover;

a conduit extending from the bottom of the ladle toward said opening in said cover;

a tubular outer shroud enclosing said conduit and extending from said ladle bottom through said opening in the covered tundish;

means for adding fume-emitting ingredients to said stream of molten steel in said outer shroud;

an exhaust hood located between said ladle and said tundish and having an exhaust inlet located adjacent said top opening of the covered tundish;

said exhaust hood comprising means for collecting said fumes generated in said tundish and said shroud;

and baffles located adjacent said top opening and extending between the bottom of the ladle and the top of the covered tundish;

said baffles comprising means for substantially confining said fumes to the vicinity of said exhaust inlet.

30. Apparatus for strand casting steel, wherein undesirable fumes are generated, and for preventing said fumes from polluting the work-place environment, said apparatus comprising:

a ladle;

a tundish comprising means for receiving a stream of molten steel from said ladle;

means for casting said molten steel into a strand at a location below said tundish;

means for spray cooling said strand downstream of the tundish;

means for torch cutting the strand downstream of the spray cooling means and for generating fumes which are relatively wet and cool;

a bag house;

means for collecting gases containing said fumes generated at the torch cutting means and for directing said gases through said bag house to clean the gases;

said gas collecting means comprising means for collecting gases at a first location directly below said torch cutting means and means for collecting gases at a second location immediately downstream of said torch cutting means and above said first collecting location.

31. Apparatus for strand casting steel, wherein undesirable fumes are generated, and for preventing said fumes from polluting the work-place environment, said apparatus comprising:

a ladle;

a tundish comprising means for receiving a stream of molten steel from said ladle;

means for casting said molten steel into a strand at a location below said tundish;

means for spray cooling said strand downstream of the tundish;

means for torch cutting the strand downstream of the spray cooling means and for generating fumes which are relatively wet and cool;

means for generating relatively hot, dry gases immediately downstream of said spray-cooling means and upstream of said torch cutting means;

a bag house;

means for collecting gases containing said fumes generated at the torch cutting means and for directing said gases through said bag house to clean the gases;

means for collecting the relatively hot, dry gases generated immediately downstream of the spray cooling means;

and means for mixing said relatively hot, dry gases generated downstream of said spray cooling means with said relatively cool, wet fumes from the torch cutting means, at a location upstream of said bag house.

32. An apparatus as recited in claim 31 and comprising:

cyclone separating means located upstream of said mixing means;

and means for directing said gases collected at said torch cutting means into said cyclone separating means, to remove relatively large droplets of moisture from said gases.

33. An apparatus as recited in claim 31 wherein:

the location of said means for generating said relatively hot, dry gases is sufficiently close to the location of said torch cutting means so that said hot, dry gases retain sufficient heat at the time they reach said mixing location to maintain the temperature of the mixed gases above the dew point thereof when the mixed gases enter the bag house.

34. An apparatus for strand casting steel, wherein undesirable fumes are generated, and for preventing said fumes from polluting the work-place environment, said apparatus comprising:

a ladle;

a tundish comprising means for receiving a stream of molten steel from said ladle;

means for collecting fumes generated in said tundish;

means for casting said molten steel into a strand at a location below the tundish;

means located downstream of said casting means for torch cutting said strand and for generating fumes which are relatively cool and wet compared to the fumes generated at said tundish;

a bag house;

means for collecting gases containing said fumes generated at the torch cutting means and for directing said gases through said bag house to clean the gases;

and means for mixing said fumes from the tundish with said relatively cool, wet fumes from the torch cutting means, at a location upstream of said bag house.

35. An apparatus as recited in claim 34 and comprising:

means for providing a substantial delay period between the initial reception of said molten steel at the tundish and the time said strand first reaches said torch cutting means;

and means for directing gases containing the fumes generated at said tundish through said bag house during said delay period to preheat the bag house before the fumes at said torch cutting means are directed into the bag house.

36. An apparatus as recited in claim 34 and comprising:

cyclone separating means located upstream of said mixing means;

and means for directing said gases from said torch cutting means into said cyclone separating means, to remove relatively large droplets of moisture from said gases.

37. An apparatus as recited in claim 34 and comprising:

means for spray cooling said strand downstream of the tundish and upstream of the torch cutting means;

means for generating relatively hot, dry gases immediately downstream of said spray-cooling means and upstream of said torch cutting means;

means for collecting the relatively hot, dry gases generated immediately downstream of the spray cooling means;

and means for mixing said relatively hot, dry gases generated downstream of said spray cooling means with said relatively cool, wet fumes from the torch cutting means, at a location upstream of said bag house.

38. An apparatus as recited in claim 37 wherein:

the location of said means for generating said relatively hot, dry gases is sufficiently close to the location of said torch cutting means so that said hot, dry gases retain sufficient heat at the time they reach said mixing location to maintain the temperature of the mixed gases above the dew point thereof when the mixed gases enter the bag house.

* * * * *